United States Patent [19]

Ueda et al.

[11] Patent Number: 4,809,919

[45] Date of Patent: Mar. 7, 1989

[54] METHOD AND APPARATUS FOR WINDING YARN IN AUTOMATIC WINDER

[75] Inventors: Yutaka Ueda, Nara; Isamu Ikeda, Kameoka; Masaharu Kiriake, Uji; Kazuhiko Nakada, Kyoto, all of Japan

[73] Assignee: Murata Kikai Kabushiki Kaisha, Kyoto, Japan

[21] Appl. No.: 104,360

[22] Filed: Oct. 2, 1987

[30] Foreign Application Priority Data

Oct. 6, 1986 [JP] Japan ..... 61-237661

[51] Int. Cl.[4] ..... B65H 54/20; B65H 63/00; B65H 67/06

[52] U.S. Cl. ..... 242/35.5 R; 242/35.5 A; 242/35.6 R; 242/36

[58] Field of Search ..... 242/35.5 R, 35.5 A, 242/36, 35.6 R; 57/264, 266, 78

[56] References Cited

U.S. PATENT DOCUMENTS

| | | | |
|---|---|---|---|
| 4,512,526 | 4/1985 | Tone et al. | 242/36 |
| 4,532,759 | 8/1985 | Bischofberger | 242/35.5 A X |
| 4,566,644 | 1/1986 | Kiriake | 242/35.5 A |
| 4,576,341 | 3/1986 | Matsui et al. | 242/35.5 A |
| 4,634,066 | 1/1987 | Matsui et al. | 242/35.5 A |

*Primary Examiner*—Stanley N. Gilreath

*Attorney, Agent, or Firm*—Spensley Horn Jubas & Lubitz

[57] ABSTRACT

In an automatic winder comprising plural winding units, a preset yarn quantity per lot and a residual quantity of yarn to be taken up are grasped upon generation of a full-loaded signal, then the number of operating winding units is decreased gradually, allowing operation of only winding unit or units of a number corresponding to the residual quantity of yarn to be taken up.

17 Claims, 6 Drawing Sheets

METHOD AND APPARATUS FOR WINDING YARN IN AUTOMATIC WINDER

FIELD OF THE INVENTION

The present invention relates to a method of winding yarn at the time of changeover from one to another lot in an automatic winder and an apparatus for practising the method.

RELATED ART STATEMENT

It is well known to wind yarn produced by a spinning frame onto a bobbin and rewind the spinning bobbin by means of an automatic winder in the next step to obtain a package having predetermined yarn quantity and shape.

One such automatic winder is composed of plural winding units disposed side by side. When the quantity of wound yarn calculated or detected in one winding unit reaches a predetermined value, the winding operation of this winding unit once stops and a full-loaded package is removed from the winding unit by the operator or an automatic doffing device, then a new empty take up tube is fed and the winding operation is restarted.

In producing a predetermined number of full-loaded packages in such automatic winder, a full-loaded signal from each winding unit is transmitted to a control section by means of a constant length mechanism or a constant shape mechanism. In the control section, +1 is added at every input of such full-loaded signal, and when the addition value becomes equal to a preset value, a winding stop signal is provided to all the winding units of the automatic winder, whereby the winding operation of each winding unit is stopped.

Thus, until just before the issuance of the stop signal from the control section, the winding operation of each winding unit is still continued, and the quantity of yarn of the take-up package on the cradle arm of each winding unit differs between winding units. If the winding stop signal is provided to all the winding units in such a state, there will be produced a large number of half-loaded packages. Such half-loaded packages are once removed from the winding units, then gathered and rewound into packages of predetermined quantity and size. In other words, it becomes necessary to deal with a large number of half-loaded packages at every change of lot for each kind of yarn. This is very troublesome.

OBJECT AND SUMMARY OF THE INVENTION

It is an object of the present invention to propose a method whereby the number of a half-loaded package during take-up can be minimized at the time of lot change.

According to the present invention, in an automatic winder comprising a plurality of winding units, a preset yarn quantity per lot and a residual quantity of yarn to be taken up are determined upon generation of a "fully-loaded" signal.

That is, when one or more of the winding units emits a signal indicating that a package is fully wound, the amount of yarn which has been wound on the packages up to that point in time is calculated by a controller. The quantity of residual yarn (i.e. the amount of yarn still to be taken-up) is calculated by subtracting the amount of yarn which has been wound on the packages up to that point from the amount of yarn needed for one lot. Then, the number of operating winding units is decreased gradually, allowing operation of only that number of winding units necessary to take up the residual quantity of yarn.

Therefore, in the present invention, the number of operating winding units decreases gradually after a certain point in time. When a quantity of yarn corresponding to one lot has been taken up, only one winding unit or a very small number of winding units are still in operation. The majority of winding units have discontinued winding operations and stand in a state in which no yarn layer is present (at least on the take-up side). Only one half-loaded package or a very few half-loaded packages are present when the changeover from one lot to another lot is performed.

DETAILED DESCRIPTION OF EMBODIMENTS

An embodiment of the present invention will be described hereinunder with reference to the drawings.

Figure 9:
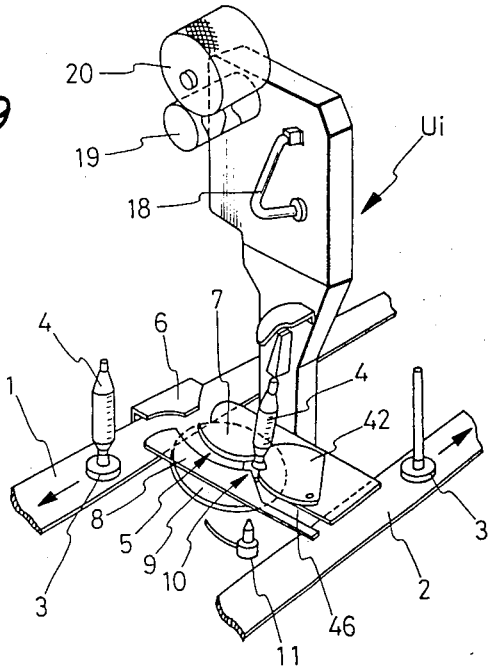
FIG. 9 is a schematic constructional perspective view showing an example of a winding unit.
Figure 10:
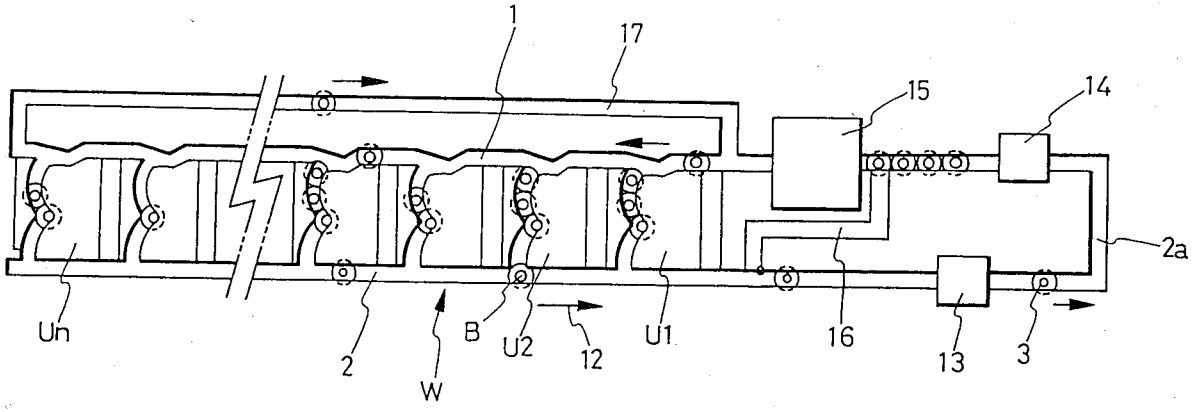
FIG. 10 is a layout plan view showing an example of a bobbin conveyance system in a winder.

FIGS. 9 and 10 show an example of an automatic winder to which the present invention is applied. In those figures, a plurality of winding units Ul-Un are disposed side by side to constitute a winder W as shown in FIG. 10. The winding units are positioned between a spinning bobbin conveyance path 1 and an empty bobbin conveyance path 2. As shown in FIG. 9, a spinning bobbin 4 mounted on a tray 3 is automatically taken into a passage 5 of each winding unit by means of guide plates 6, 7, 8 and a disc 9. In this way, a predetermined number of spinning bobbins are stocked in the passage 5. Under the bobbin located in a rewinding position 10 there is provided a pressure air injection nozzle 11 connected to a pressure air supply source (not shown). The pressure air injected from the nozzle 11 spouts into the core tube of the spinning bobbin through an air passage formed in the tray and blows up outwards the yarn end hanging into the core tube from the upper end. Then, a stand-by suction pipe 18 seizes the yarn end and guides it to a yarn joining device. Each winding unit is further provided with a traverse drum 19 and a yarn clearer, and the yarn is taken up to a package.

The bobbin ejected from the winding unit is conveyed together with the tray in the direction of an arrow 12 along the empty bobbin conveyance path 2. Then, in a bobbin handling station 13, an empty bobbin or a bobbin with extremely slight remaining yarn is pulled out from the tray and transferred as an empty tray 3 to a spinning bobbin supply station 14. The tray supplied with a spinning bobbin at the station 14 is fed through a yarn end finding device 15 to the winding unit side.

Among the bobbins discharged from the winder there is a so-called partial bobbin having judged to be a yarn joining impossible bobbin and having a large quantity of yarn layer, or a later-described surplus bobbin. Therefore, such a bobbin can be fed again to the winding unit (Ul–Un) side through the yarn end finding device 15 past the bobbin handling station 13 and the spinning bobbin supply station 14 without stopping.

As shown in FIG. 10, moreover, the said bobbin may be fed to the yarn end finding device 15 through a bypass 16 without going through the stations 13 and 14. Numeral 17 denotes a recycle path for the feedback of spinning bobbins which have not been taken into any of the winding units from above the spinning bobbin conveyance path 1.

The following description is now provided about a lot changing method in such winder according to the present invention.

Figure 1:
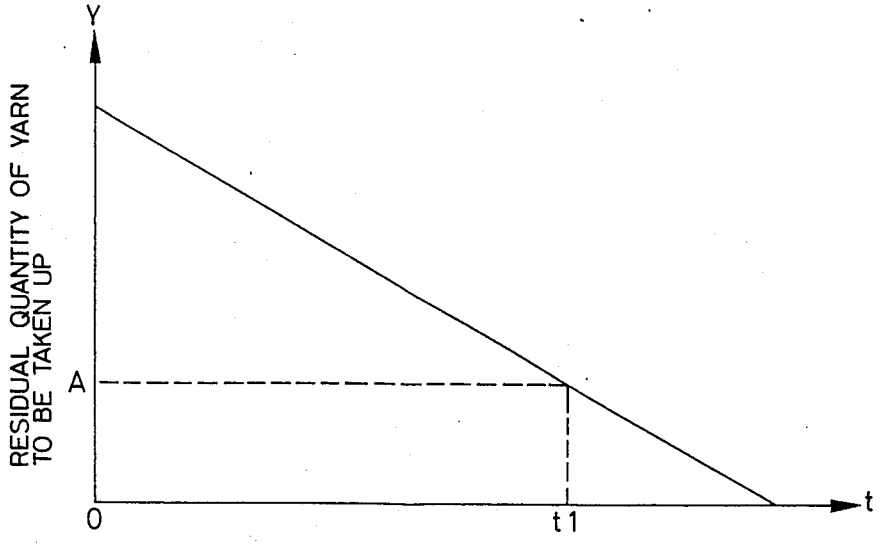
FIG. 1 is a diagram explaining a start timing of a lot changing control according to the present invention.
Figure 2:
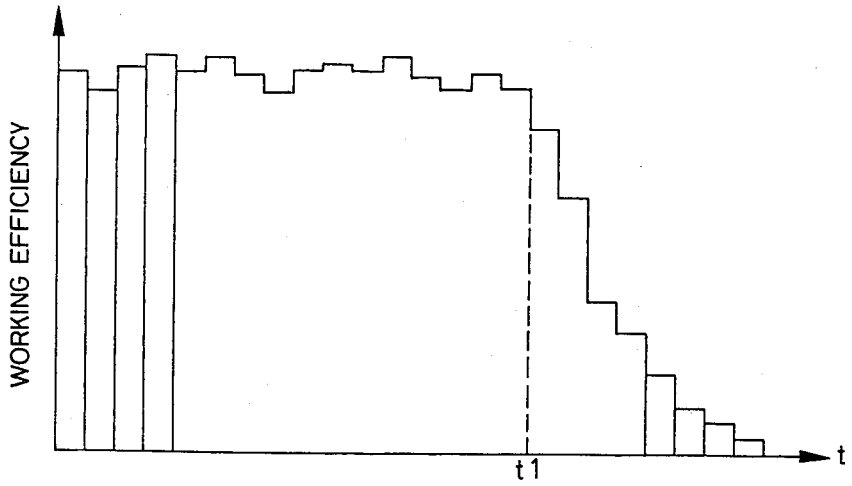
FIG. 2 is a graphic diagram showing changes in working efficiency caused by changes in operating winding units based on the said control.

Referring to FIGS. 1 and 2, it is here assumed that a winder as shown in FIG. 10 is composed of 60 winding units and that one lot of 800 full-loaded packages are produced in the winder. In this case, the residual quantity of yarn to be taken up at time (t=0) in FIG. 1 is Y-800. Full-loaded packages are produced successively with the lapse of the winding time and the number of such packages produces is counted. And when the residual quantity of yarn to be taken up reaches a value corresponding to the quantity (A) of packages produced at one doffing in all the winding units, the operation of the winding units which have become full-loaded as packages is stopped and the supply of new spinning bobbins into those winding units is discontinued. Then, a further control is made to discharge all the bobbins remaining in those winding units and supply the discharged bobbins to the other winding units which are in operation. More specifically, as shown in FIG. 2, the sixty winding units continue the normal winding operation until time tl and the number of operating winding units change unevenly with the lapse of time as graphically shown in the figure. From the time tl the number of operating units decreases gradually and when preset one lot of packages have been produced, the winding units are turned off with one unit having a package not fully loaded yet, thus giving rise to one half-loaded package, or all the winding units stop operation without giving rise to a half-loaded package in the case where control is made in terms of the number of packages.

In the above example, 800 packages are produced by the winder composed of 60 winding units, so the lot changing control is not performed until 800−60=740 packages are produced, but it is started when the residual number of packages to be produced has become 60. Thereafter, every time a full-loaded package is produced, the operation of the winding unit concerned is stopped, and finally it is only one unit that is producing one remaining package. When the said package becomes full-loaded, the production of one lot is completed in the absence of a half-loaded package.

Where the yarn quantity of one lot is determined in terms of the yarn length, the final one package is a half-loaded package. More specifically, if the total production quantity is Y meters, tee length of yarn taken up one full-loaded package is X meters and the total number of packages is N, a half-loaded package will not be produced if $NX=Y$, while if $(N-1)\ X+\alpha=Y$, one package will be a half-loaded package having a yarn length of $\alpha$ meters, provided $\alpha<X$.

The above control is effected by a system which will be described below.

Figure 3:
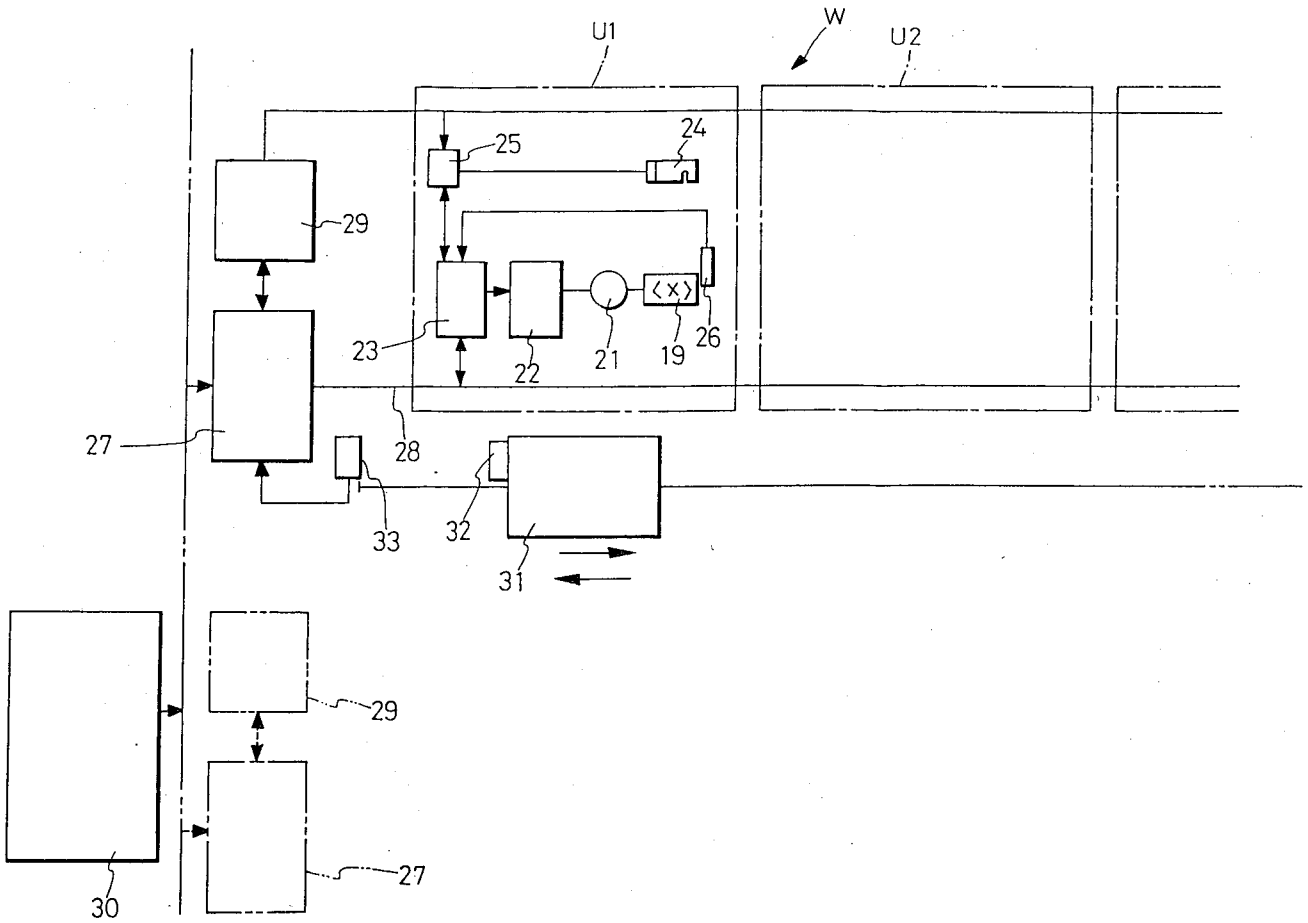
FIG. 3 is a block diagram showing an example of a control system which practices the method of the present invention.

FIG. 3 is a block diagram for performing the above control. The frame Ul enclosed with a dot-dash line represents a winding unit. Plural such units are disposed side by side to constitute a single winding machine W. In each winding unit UI there are provided a traverse drum 19, a motor 21 for driving the traverse drum, an inverter 22 for controlling the motor, a unit controller 23 which provides commands to the inverter 22, a yarn defect detecting head 24, and an amplifier 25. A proximity sensor 26 for detecting the rotation of the drum 19 is provided near an end face of the drum, and a detected drum rotation signal is input to the unit controller 23 for utilization in constant length winding. More specifically, a constant pulse is input to the controller 23 at every rotation of the drum and is converted to a yarn travel length, or the pulse signal is added directly. Upon input of a predetermined number of such pulses, it is judged that the package in the winding unit concerned has become full-loaded.

Further, together with the signal from the sensor 26, a yarn travel signal obtained by the yarn defect detecting head 24 is fed to the unit controller 23. Both signals pass through an AND circuit, whereby the actually wound yarn length is detected.

Also provided in the winder W is a controller 27 containing a microcomputer for controlling or monitoring the whole of the winding units. Transmission and reception of signals to and from the winding units are performed using a signal line 28, whereby information on each unit is obtained and a command is output to each unit. Numeral 29 denotes a clearer controller which controls a clearer for detecting yarn defects in each winding unit. The controller 27 mounted in each winder is further connected to a central controller 30 through a signal line and there is made transmission and reception of information between the central controller 30 and each winder.

Numeral 31 in FIG. 3 denotes an automatic doffing car which moves along the winding units. The doffing car 31 stops in a winding unit position where there is a doffing request signal, then removes a full-loaded package on the unit, supplies a new empty take-up tube and allows the winding operation to be re-started automatically. Various types of doffing cars have already been proposed and used.

In this embodiment, the doffing car 31 and the controller 27 in the winder are connected by optical communication and information is transmitted and received therebetween continually through light emitter-detectors 32 and 33 mounted on the car side and the winder side, respectively. Various informations can be transmitted and received; for example, information on the number of times of doffing of the doffing car or the present location of the car is transmitted from the doffing car 31 to the controller 27, while from the controller 27 to the car 31 there are transmitted commands on right or left travelling, start and stop of the car, winding re-start or stop command signal after the doffing operation, etc.

The lot changing operation in the above winder will be explained below. In the following explanation, one lot is defined by the length of yarn, which length is assumed to be L meters, utilizing a full-loaded signal provided from a constant length mechanism mounted in each winding unit. By way of explanation, it is here assumed that the number of winding units in one winder is 10.

Figure 4:
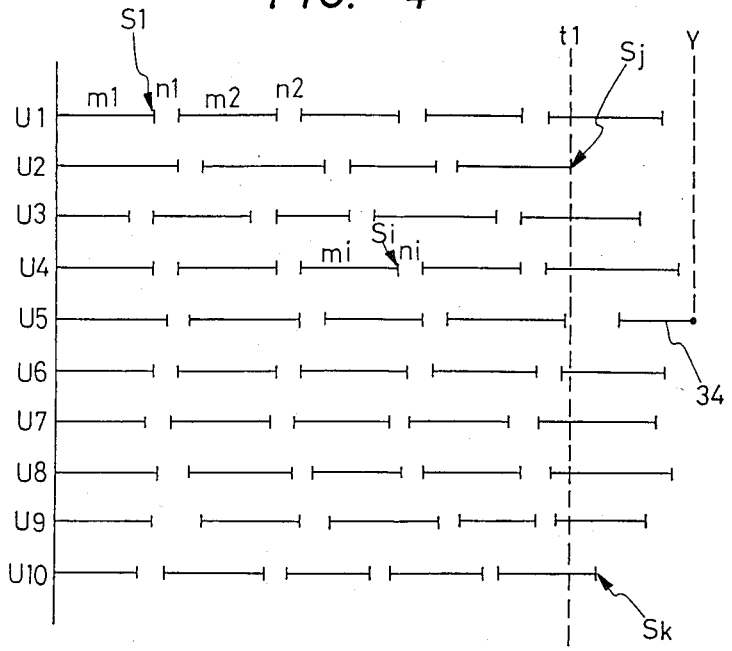
FIG. 4 is a schematic diagram showing an example of a package producing step according to the present invention.

In FIG. 4, the time mi required for obtaining one full-loaded package in each unit differs depending on the number of times of yarn breakage, troubles, etc., and the time ni required after issuance of full-loaded signals Sl-Si from winding units until completion of the doffing operation after arrival of the travelling doffing car at the position of each winding unit concerned also differs depending on various factors. Consequently, such a random doffing or production of full-loaded packages as shown in the figure is performed.

Assuming that the length (l) of yarn to be further taken up is $9X<l<10X$ (X being the yarn length of one full-loaded package) at time tl, a lot changing control is started from the said time tl, and with respect to the winding unit U2 which generated a full-loaded signal Sj at the time tl, the winding operation is completed and the re-start of the next new winding operation is prevented. In other words, the doffing car merely removes the full-loaded package on the winding unit from the same unit, and the operation for the next winding such as winding the new feed-side yarn end round a take-up tube is prevented.

In the other winding units than the unit U2 the winding operation is continued. If a winding unit U10 next becomes full-loaded as indicated at Sk, the re-start of winding is prevented also in that unit. In this way the winding operation is stopped in the order of units U3→U9→U7→U6→Ul→U8→U4. At this time, it is only the unit U5 that is in operation; that is, the yarn of a quantity corresponding to one lot is taken up halfway in the winding operation of that winding unit, so it is very likely that the operation of the unit U5 will be stopped without issuing of a full-loaded signal, leaving a half-loaded package 34.

In each of the winding units whose winding operation has been discontinued by the lot changing control, the remaining spinning bobbin is delivered to another winding unit which is in operation, while the supply of a new spinning bobbin to the winding units which are not in operation is prevented. To this end there is provided a controller for the bobbins on the feed side. More specifically, control is made so that when the winding of yarn for one lot is over, one half-loaded package remains on the upper take-up side of one unit, while one bobbin with residual yarn remains on the lower feed side. Thus, at the time of changeover from one to another lot, neither a spinning bobbin on the feed side nor a package under winding is present in almost all the winding units of the winder; as a result, winding preparations for the new lot can be done in a short time.

Figure 5:
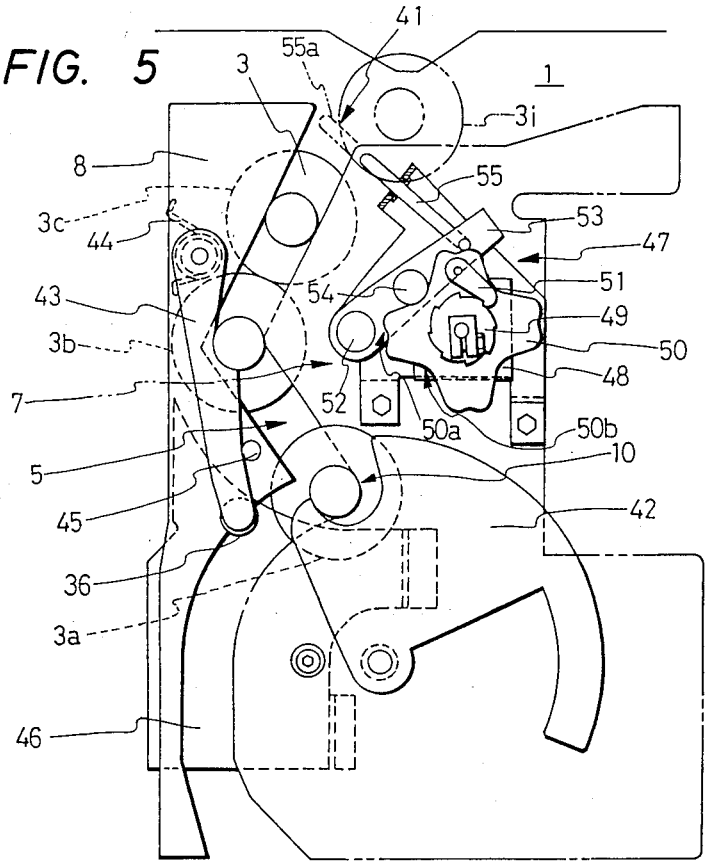
FIG. 5 is a plan view showing an example of means for preventing the supply of a new bobbin to a winding unit.
Figure 6:
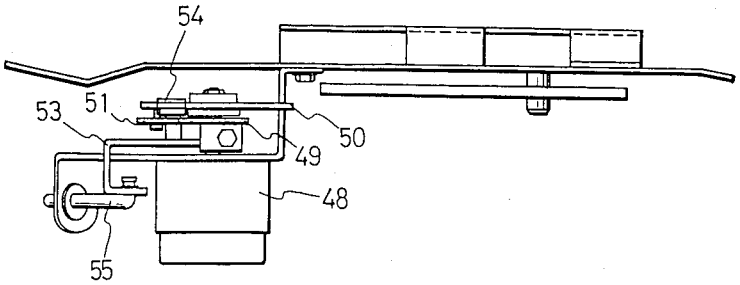
FIG. 6 is a front view thereof.

The controller for the feed-side bobbins will now be explained with reference to FIGS. 5 to 8. FIGS. 5 and 6 show an example of an apparatus for preventing a spinning bobbin from being taken in the winding unit shown in FIG. 9. A spinning bobbin is taken in the winding unit automatically if there is vacancy in the passage 5 by means of the guide plates 6, 7 and 8 and by the travelling force of the belt 1, which are illustrated in FIG. 9. Therefore, when there is no need of a new bobbin, the inlet of the passage 5 is closed by projection of a stopper to let the bobbin pass the winding unit without stopping, allowing it to be taken in another winding unit. More specifically, in FIGS. 5 and 6, the bobbin passage 5 in a winding unit Ui is formed by the guide plates 7 and 8, and a spinning bobbin integral with the tray 3 is fed into the passage 5 through an inlet 41 from the conveyance path 1. In the bobbin rewinding position 10 the bobbin is located in a recess of a delivery lever 42 and in this state there is performed rewinding. Numeral 43 denotes a movable stopper for forming space between a bobbin tray 3*a* under winding operation and stand-by bobbin trays 3*b*, 3*c* to prevent ballooning contact. A part of the lever 43 which is biased with a spring 44 engages a part of the tray 3*b* to define the tray stand-by position. Numeral 45 denotes a stop pin for the lever 43. When the bobbin in the take-up position is discharged from the unit through a discharge path 46 with counterclockwise pivoting of the delivery lever 42, a roller 36 attached to the fore end of the lever 43 is pushed by the tray 3*a*, so that the tray 3*b* and the lever 43 become disengaged from each other, allowing the next bobbin to be transferred to the take-up position 10.

An example of a stopper device 47 provided at the inlet of the passage 5 is shown in FIG. 5. In this example, when a rotary solenoid 48 is turned ON once, a clutch 49 fixed to the solenoid shaft turns 45° in a clockwise direction, so that a hook 51 on a cam plate 50 comes into engagement with a pawl of the clutch and turns 45° together with the cam plate 50. A cam follower 54 on a lever 53 pivotably supported by a fixed shaft 52 mounts a land portion 50*a* of the cam plate 50 and the lever 53 turns counterclockwise at a certain angle, so that a stop arm 55 on the lever 53 projects from a stand-by position indicated by a solid line to an operative position 55*a* indicated by a dash-double dot line to prevent the tray 3*i* from entering the passage 5. Upon turning OFF of the solenoid 48, the clutch 49 turns counterclockwise and returns to its original position, but the cam plate 50 maintains the present state thereof because such clockwise rotation of the clutch 49 keeps the hook 51 out of engagement with the pawls of the clutch. For rendering the stop arm inoperative, the solenoid is turned ON, whereby the clutch turns 45° clockwise and at the same time the lever 53 falls to a recessed portion 50*b* of the cam plate, thus permitting the stop arm 55*a* to return to its stand-by position 55.

The on-off command for the solenoid 48 can be effected from the controller 27 of the winder or from the central controller 30, which are shown in FIG. 3.

The delivery mechanism for spinning bobbins stocked in each winding unit will be explained below with reference to FIGS. 7 and 8. According to this mechanism, bobbins remaining in any winding unit which has produced a full-loaded package after the time tl in FIGS. 1 and 2 are delivered to other winding units.

The discharge of bobbin is performed by the lever 42 shown in FIG. 5. The bobbin located in the take-up position is ejected by a single operation.

Figure 8:
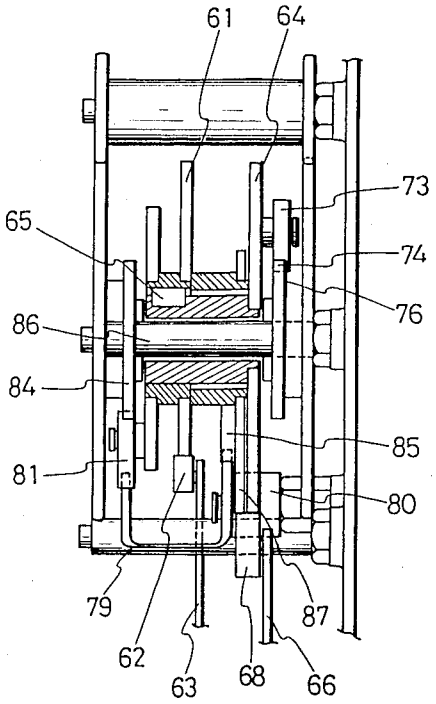
FIG. 8 is a partially sectional side view thereof.
Figure 7:
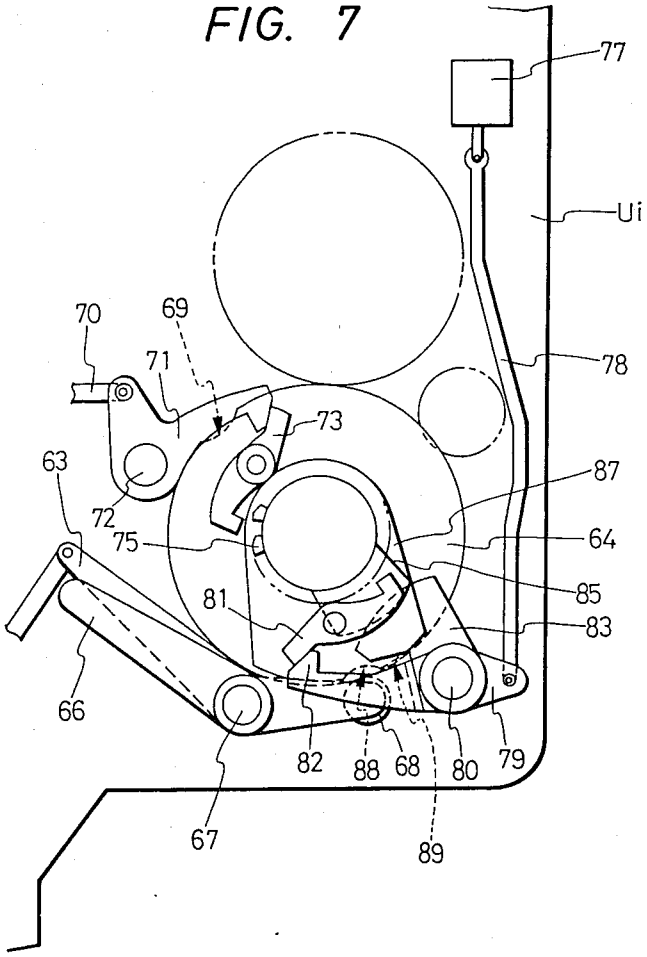
FIG. 7 is a front view showing an example of a delivery mechanism for forcibly discharging bobbins which remain in a winding unit.

In FIGS. 7 and 8, the bobbin delivery lever (42 in FIG. 5) is actuated by a cam lever 63 with a cam follower 62 in pressure contact with an inject cam 61, through a connecting rod (not shown).

In the above embodiment, upon arrival of a new bobbin at the take-up position, the valve of the pressure air injection nozzle 11 located under the take-up position as shown in FIG. 9 is turned ON, allowing pressure air to be injected from the hollow portion of the tray into the central bore of the bobbin and blow up the depending yarn end. To this end, the inject cam 61 and a blow-up cam 64, which are shown in FIG. 8, are interconnected by a key 65 to ensure integral rotation of the two.

Therefore, it is necessary that the injection of pressure air be stopped during the delivery of a bobbin after the production of a full-loaded package. Only the bobbin is discharged. Numeral 66 denotes a lever for actuating the above pressure air valve. The valve actuating lever 66 is pivotally supported by a fixed shaft 67 and one end thereof is connected to a valve actuating member, while a cam follower 68 is provided at the opposite end thereof. The cam follower 68 is adapted to fall into a recessed portion 69 of the blow-up cam 64 whereby the lever 66 is actuated. In normal operation, a rod 70 is pulled by a drive means such as solenoid in accordance with a bobbin change command to let a hook lever 71 turn counterclockwise about a fixed shaft 72 at a certain angle, allowing a clutch hook 73 supported by the blow-up cam 64 to turn counterclockwise by virtue of a spring and come into engagement with a pawl 75 of a clutch 74, so that the cam 64 rotates together with the clutch 74 which rotates integrally with a gear 76, thus causing rotation of the inject cam 61 for the delivery lever which cam is connected to the blow-up cam 64. In this way the bobbin delivery and the yarn end blowing up for the bobbin newly fed are effected in appropriate timing.

In discharging a bobbin remaining in a winding the production of a full-loaded package, a solenoid 77 shown in FIG. 7 turns ON in accordance with a command provided from the controller 27 or 30 and a release lever 79 turns counterclockwise about a fixed shaft 80 at a certain angle through a rod 78. The release lever 79 is integrally formed with an engaging piece 82 which engages a clutch hook 81 and a release segment 83. With pivoting of the release lever 79, the clutch hook 81 comes into engagement with a pawl of a clutch 84 shown in FIG. 8, the clutch 84 having pawls similar to the pawls of the clutch 74. At the same time, a segment 85 engaged with the release segment 83 turns clockwise about a shaft 86 at a certain angle, so that an anti-blow-up plate 87 integral with the segment 85 turns in the same direction. A recessed portion 88 is formed in a part of the peripheral surface of the anti-blow-up plate 87. When the recessed portion 88 is in its position shown in FIG. 7 and when the recessed portion 69 of the blow-up cam 64 comes into coincidence with the recessed portion 88 with rotation of the cam 64, the cam follower 68 falls into the recessed portions 69 and 88, causing the pressure air injection lever 66 to operate. However, when the release lever 79 operates upon turning ON of the solenoid 77, the anti-blow-up plate 87 integral with the segment 85 turns to a slight extent and the recessed portion 88 thereof shifts to a position deviated from the position of the roller 68, so even when the recessed portion 69 of the cam plate 64 reaches the position of the roller 68, the roller 68 is hindered by the peripheral surface 89 of the anti-blow-up plate 87, thus keeping the lever 66 inoperative.

Therefore, in a winding unit which has produced a full-loaded package after the start of the lot changing control, the injection of pressure air is prevented during the bobbin delivery operation, allowing the yarn end in the bobbin central bore to be delivered without flying out to the exterior, so the bobbin delivery and conveyance can be done without entwining of the yarn end round another member.

As to the operation of the release solenoid 77, in the case where there are two bobbin stand-by positions in a winding unit as shown in FIG. 5, all the bobbins, including the bobbin in the take-up position, in the winding unit are discharged by turning ON the release solenoid three times. It is desirable that when the rotation of the traverse drum stops upon production of a full-loaded package, the yarn connecting between the full-loaded package and a bobbin located on the feed side be cut positively and that the bobbin delivery be done in a disconnected state of the yarn of the feed-side bobbin from the package. This can be attained by operation of a known cutter provided in the yarn path of the winding unit in accordance with a full-loaded signal.

Therefore, when, for example, the unit U2 in FIG. 4 stops operation in a full-loaded condition after start of the lot changing control shown in FIGS. 1 and 2, the stop arm shown in FIG. 5 projects and all the bobbins remaining in the unit U2 are discharged from the same unit. In the above example, each bobbin B discharged from the unit U2 as shown in FIG. 10 is conveyed along the conveyance path 2 in the direction of arrow 2, then passes through the conveyance path 2*a* or the by-pass 16 and is again transferred to the bobbin feed path 1 for its feed to another winding unit which is under winding operation.

In this way, once the lot changing control is started, the winding units which have produced full-loaded packages stop operation successively, and just before the production of one lot yarn, only one winding unit is in operation, while all the other winding units have already completed preparations for lot change, thus permitting production of the next one lot yarn immediately after the completion of one lot production.

Although in the above embodiment a full-loaded signal provided from the constant length mechanism was utilized for the detection of lot size, the number of times of doffing of the doffing car 31 shown in FIG. 3 may be added to detect a preset one lot size.

Further, although in the above embodiment reference was made to the lot changing control in the bobbin conveyance system using trays, the method of the present invention is also applicable to an existing magazine type winder in which in each winding unit spinning bobbins are stocked in plural cylindrical magazines provided in the vicinity of the winding unit, and a magazine turns one pitch in accordance with a bobbin request signal whereby one spinning bobbin is fed; or to a type in which winding units circulate.

According to the present invention, as set forth hereinabove, in an automatic under composed of plural winding units, the number of a half-loaded package during take-up can be minimized or made zero at the time of lot change, thus permitting extremely quick lot change, namely the change from one to another kind. Therefore, the present invention is effective particularly in a spinning winder applied to a system for low volume production of various kinds which requires frequent lot change.

What is claimed is:

1. A method of winding yarn and forming a lot of full packages in an automatic winder having a plurality of winding units for winding yarn packages, the method comprising the steps of:

supplying spinning bobbins to the plurality of winding units, counting the number of full packages wound by the plurality of winding units, calculating a residual number of full packages by subtracting the number of full packages wound by the plurality of winding units from the number of full packages in the lot of full packages, supplying a stop winding signal to the plurality of winding units when the residual number of full packages is equal to a predetermined value, stopping the operation of each winding unit that has received the stop winding signal after the winding unit has wound a full package, and discontinuing the supply of spinning bobbins to each winding that has received the stop winding signal, whereby the plurality of winding units in operation is gradually decreased after supplying the stop winding signal.

2. A method as in claim 1 wherein the predetermined value is equal to the number of winding units.

3. A method of winding yarn and forming a lot of full packages in an automatic winder having a plurality of winding units for winding yarn packages, the method comprising the steps of:

supplying spinning bobbins to the plurality of winding units, counting the quantity of yarn wound by the plurality of winding units, calculating a residual quantity of yarn by subtracting the quantity of yarn wound by the plurality of winding units from the quantity of yarn in the lot of full packages, supplying a stop winding signal to the plurality of winding units when the residual quantity of yarn is equal to a predetermined value, stopping the operation of each winding unit that has received the stop winding signal after the winding unit has wound a full package, and discontinuing the supply of spinning bobbins to each winding that has received the stop winding signal, whereby the plurality of winding units in operation is gradually decreased after supplying the stop winding signal.

4. A method as in claim 3 wherein the predetermined value is equal to the quantity of yarn produced at one doffing of the plurality of winding units.

5. A method of winding yarn as claimed in claim 1 or 3, wherein at least one of the winding units includes a rotatable drum having an end face, a proximity sensor adjacent the end face of the drum, and a yarn defect detecting head, and further comprising the steps of:

detecting a drum rotation signal by the proximity sensor adjacent the end face of the drum, detecting a yarn travel signal by the yarn defect detecting head, and supplying both the drum rotation signal and the yarn travel signal to an AND circuit, whereby an actually wound yarn length is detected.

6. An apparatus for winding yarn and forming a lot of full packages in an automatic winder having a plurality of winding units for winding yarn packages, the apparatus comprising:

supply means for supplying spinning bobbins to the plurality of winding units, counting means for counting the quantity of yarn wound by the plurality of winding units, calculating means for calculating a residual quantity of yarn by subtracting the quantity of yarn wound by the plurality of winding units from the quantity of yarn in the lot of full packages, supply means for supplying a stop winding signal to the plurality of winding units when the residual quantity of yarn is equal to a predetermined value, stopping means for stopping the operation of each winding unit that has received the stop winding signal after the winding unit has wound a full package, and means for discontinuing the supply of spinning bobbins to each winding that has received the stop winding signal, whereby the plurality of winding units in operation is gradually decreased after supplying the stop winding signal.

7. An apparatus as in claim 6 wherein the plurality of winding units are disposed between a spinning bobbin conveyance path and an empty bobbin conveyance path and wherein at least one of the plurality of winding units further comprises:

guide means for defining a bobbin passage between the spinning bobbin conveyance path and the empty bobbin conveyance path, stop means provided between the spinning bobbin conveyance path and the bobbin passage for preventing movement of the spinning bobbin from the spinning bobbin conveyance path to the bobbin passage, delivery means for ejecting a spinning bobbin from the winding unit, and controller means for monitoring the plurality of winding units and for controlling the stops means and the delivery means.

8. An apparatus as claimed in claim 7 wherein the controller means generates an on-off command and wherein the stop means further comprises:

a rotary solenoid having a shaft and being rotatable in response to the on-off command generated by the controller means, a clutch having at least one pawl and being secured to the shaft of the rotary solenoid, a cam plate having a hook engageable with the pawl of the clutch, a lever having a cam follower in abutment with the cam plate, and a stop arm connected to the lever, the stop arm projecting from a stand-by position to an operative position to prevent the spinning bobbin from entering the bobbin passage upon rotation of the solenoid in response to the on-off command generated by the controller means.

9. An apparatus for winding yarn as claimed in claim 7, wherein the delivery means further comprises:

ejection means for ejecting and delivering to another winding unit bobbins remaining in a winding unit which has received the stop winding signal after the winding unit has wound a full package.

10. An apparatus for winding yarn as claimed in claim 9, wherein the ejection means further comprises:

an inject cam, a connecting rod, and a cam lever having a cam follower in pressure contact with the inject cam through the connecting rod.

11. An apparatus for winding yarn as claimed in claim 7, wherein the spinning bobbins have central bores and are positioned on trays having hollow portions and wherein at least on of the winding units further comprises:

a pressure air injection nozzle for injecting compressed air into a hollow portion of the tray and for blowing up a depending yarn end within a central bore of a bobbin, and means for stopping the injection of compressed air during the delivery of a bobbin.

12. An apparatus for winding yarn and forming a lot of full packages in an automatic winder having a plurality of winding units for winding yarn packages, the apparatus comprising:

supply means for supplying spinning bobbins to the plurality of winding units, counting means for counting the number of full packages wound by the plurality of winding units, calculating means for calculating a residual number of full packages by subtracting the number of full packages wound by the plurality of winding units from the number of full packages in the lot of full packages, supply means for supplying a stop winding signal to the plurality of winding units when the residual quantity of yarn is equal to a predetermined value, stopping means for stopping the operation of each winding unit that has received the stop winding signal after the winding unit has wound a full package, and means for discontinuing the supply of spinning bobbins to each winding that has received the stop winding signal, whereby the plurality of winding units in operation is gradually decreased after supplying the stop winding signal.

13. An apparatus as in claim 12 wherein the plurality of winding units are disposed between a spinning bobbin conveyance path and an empty bobbin conveyance path and wherein at least one of the plurality of winding units further comprises:

guide means for defining a bobbin passage between the spinning bobbin conveyance path and the empty bobbin conveyance path, stop means provided between the spinning bobbin conveyance path and the bobbin passage for preventing movement of the spinning bobbin from the spinning bobbin conveyance path to the bobbin passage, delivery means for ejecting a spinning bobbin from the winding unit, and controller means for monitoring the plurality of winding units and for controlling the stops means and the delivery means.

14. An apparatus as claimed in claim 12 wherein the controller means generates an on-off command and wherein the stop means further comprises:

a rotary solenoid having a shaft and being rotatable in response to the on-off command generated by the controller means, a clutch having at least one pawl and being secured to the shaft of the rotary solenoid, a cam plate having a hook engageable with the pawl of the clutch, a lever having a cam follower in abutment with the cam plate, and a stop arm connected to the lever, the stop arm projecting from a stand-by position to an operative position to prevent the spinning bobbin from entering the bobbin passage upon rotation of the solenoid in response to the on-off command generated by the controller means.

15. An apparatus for winding yarn as claimed in claim 13, wherein the delivery means further comprises:

ejection means for ejecting and delivering to another winding unit bobbins remaining in a winding unit which has received the stop winding signal after the winding unit has wound a full package.

16. An apparatus for winding yarn as claimed in claim 15, wherein the ejection means further comprises:

an inject cam, a connecting rod, and a cam lever having a cam follower in pressure contact with the inject cam through the connecting rod.

17. An apparatus for winding yarn as claimed in claim 13, wherein the spinning bobbins have central bores and are positioned on trays having hollow portions and wherein at least on of the winding units further comprises:

a pressure air injection nozzle for injecting compressed air into a hollow portion of the tray and for blowing up a depending yarn end within a central bore of a bobbin, and means for stopping the injection of compressed air during the delivery of a bobbin.

* * * * *